US006976678B1

(12) United States Patent
Setteducati

(10) Patent No.: US 6,976,678 B1
(45) Date of Patent: Dec. 20, 2005

(54) AMUSEMENT DEVICE COMPLETING COMPOSITE IMAGE BY REFLECTION

(76) Inventor: Mark Setteducati, 218 E. 17 St., New York City, NY (US) 10003

( * ) Notice: Subject to any disclaimer, the term of this patent is extended or adjusted under 35 U.S.C. 154(b) by 619 days.

(21) Appl. No.: 10/042,920

(22) Filed: Jan. 8, 2002

(51) Int. Cl.[7] ..... A63F 9/00
(52) U.S. Cl. ..... 273/153 R; 273/157 R; 40/900
(58) Field of Search ..... 273/153 R, 157 R, 273/157 A; 283/72, 106; 40/124.09, 124.13, 40/900

(56) References Cited

U.S. PATENT DOCUMENTS

| | | | | |
|---|---|---|---|---|
| 169,882 A | | 11/1875 | Adams | |
| 757,549 A | * | 4/1904 | Gould | 40/124.13 |
| 2,406,743 A | | 9/1946 | Crowson | 40/125 |
| 2,483,901 A | | 10/1949 | Harris | 272/8 |
| 3,433,485 A | | 3/1969 | Benn | 273/157 |
| 4,765,656 A | | 8/1988 | Becker et al. | 283/70 |
| 4,805,955 A | * | 2/1989 | Levy | 283/56 |
| 4,854,591 A | | 8/1989 | Setteducati | 273/157 |
| 4,869,946 A | | 9/1989 | Clay | 428/167 |
| 4,898,560 A | * | 2/1990 | Moscovich | 40/900 |
| 4,935,335 A | | 6/1990 | Fotland | 430/14 |
| 5,101,184 A | * | 3/1992 | Antes | 283/91 |
| 5,301,981 A | | 4/1994 | Nesis | 283/73 |
| 5,864,973 A | * | 2/1999 | Cole | 273/157 R |

FOREIGN PATENT DOCUMENTS

| | | |
|---|---|---|
| FR | 1013723 | 8/1952 |
| GB | 1278192 | 6/1972 |

OTHER PUBLICATIONS

Copy of Packaging and Product "Rudik's Illusion" Admitted Prior. Art Publication Date Unknown.

* cited by examiner

*Primary Examiner*—Steven Wong
(74) *Attorney, Agent, or Firm*—Robert W. J. Usher

(57) ABSTRACT

An amusement device has an image carrying substrate with a corrugated surface with a transverse mirror at a rear end and is marked with first and second sets of strip-like image fragments forming, respectively, first and second composite image components. Image fragments of the second set are both differently shaped, laterally inverted and arranged alternately along the image surface relative to image fragments of the first set so that the corrugations selectively expose image fragments of the first and second sets to the front, away from the reflecting surface, and to the rear, for reflection in the reflecting surface, so that the image fragments of first and second sets combine to form first and second image components, respectively, seen by viewing, simultaneously, directly from the front and by reflection so that first and second image components combine to provide a continuous composite image not readily predicted by a casual spectator.

4 Claims, 4 Drawing Sheets

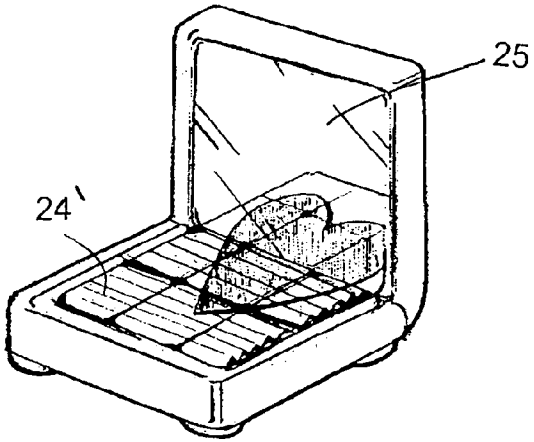
FIG 3
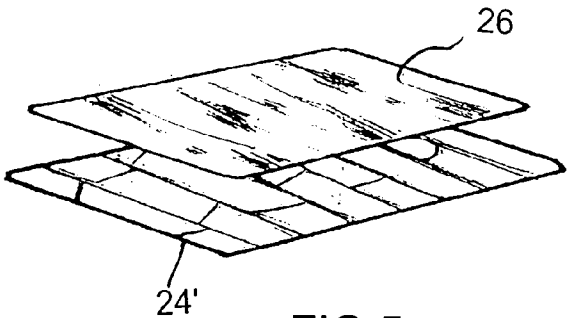
FIG 5
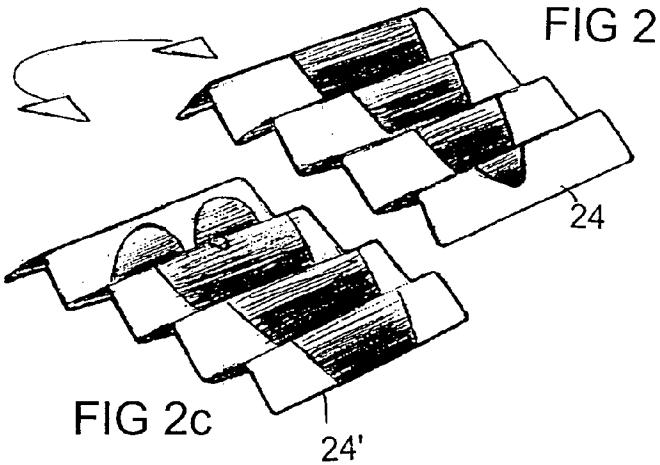
FIG 2b
FIG 2c
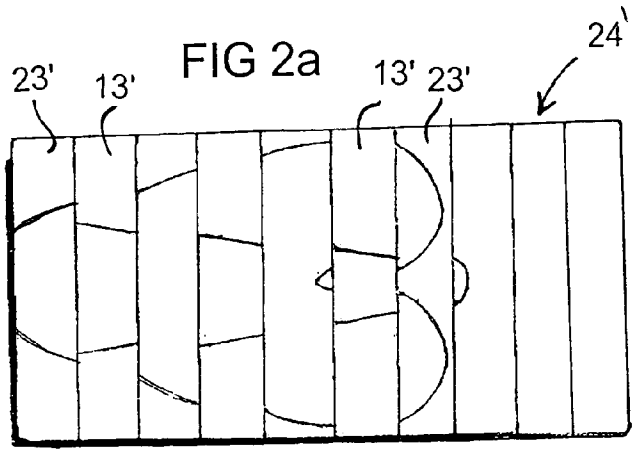
FIG 2a

AMUSEMENT DEVICE COMPLETING COMPOSITE IMAGE BY REFLECTION

FIELD OF THE INVENTION

The invention relates to an amusement device providing a composite image by combining a first image component on an image carrying substrate seen by direct transmission from a front of the carrier with a second image component seen simultaneously by reflection in a mirror behind the carrier.

BACKGROUND OF THE INVENTION

An amusement device for providing a composite image formed by combining a first image component on an image carrying substrate seen by direct transmission from a front of the carrier with a second image component seen, simultaneously, by reflection in a mirror behind the carrier is known from the prior art and has been commercial for many years.

In particular, U.S. Pat. No. 4,854,591, issued in 1989 and invented by the present applicant, teaches a three dimensional puzzle in which cubes or tiles having visual material thereon are arranged on or in front of a reflective surface so that when the cubes or tiles are correctly arranged, the image of the visual material on the cubes; or tiles seen, simultaneously, by direct transmission which forms the first image component and the reflected image of the visual material which forms the second image component are seen simultaneously, the image component combine to form a continuous composite image.

However, as the second, reflected image component of the composite image is simply a laterally inverted image of the first image component simultaneously seen directly by the spectator, the composite image resulting from the combination of the first and second image components can be readily predicted or is obvious to the spectator, the more so as the first image is symmetrical, so that the resulting composite image is not surprising and can be readily predicted by casual observation.

In a development of the invention taught by the above patent, which development has been widely sold for many years under the name "Rubik's illusion", also invented by the present applicant, the tiles or blocks arranged in front of an upright mirror have upper faces which are corrugated with each corrugation extending parallel to the mirror surface and having the cross-section of an isosceles triangle providing an image carrying surface with first and second upwardly inclined facets alternating as they extend away from the mirror and providing, respectively, first and second sets of image fragments of the first and second image components, facing forwards towards the spectator and rearward for reflection in the mirror respectively. On some of the tiles or blocks, the second sets of image fragments differ from the first set of image fragments, but in color only, so that second image component seen by reflection is not identical to the first image component seen by direct transmission. Nevertheless, as a result of the inclination of the facets required for effective viewing both from the front and by reflection in the mirror, the spectator can look down vertically on the image carrier/substrate to see the different color on the rearward facets sides during normal handling, while the remainder of the second image component is identical to the first image component which is also symmetrical, so that the resulting composite image can be readily predicted by casual observation.

SUMMARY OF THE INVENTION

It is one object of the invention to provide an amusement device of a type in which a composite continuous image resulting from the combination of a first image component provided by a first set of image fragments on an image carrying substrate seen by direct transmission with a second image component provided by a second set of image fragments on an image carrying substrate seen, simultaneously, by reflection in a rear mirror cannot be readily predicted by a spectator casually viewing the image carrying substrate.

According to the invention, the second set of image fragments providing the second image component seen by reflection is differently shaped to and laterally inverted in relation to the first set of image fragments providing the first image component seen, simultaneously, by direct transmission.

As a result, the composite image formed by the combination of the first and second set of image fragments viewed directly and by reflection in the mrror, respectively, cannot usually readily be determined by a casual inspection of the image carrying substrate even when all image fragments are seen, so that the composite image can be really surprising and a source of amusement.

According to one aspect, the invention provides an amusement device comprising an image carrying substrate with an image surface having a front end and a rear end and means for providing a reflecting surface extending transversely from the rear end, the image surface being marked with a first set of image fragments and a second set of image fragments for forming, respectively, first and second composite image components, image fragments of the second set being both differently shaped or configured and laterally inverted to image fragments of the first set and arranged alternately along the image surface to image fragments of the first set, selection means on the substrate for selectively exposing the image fragments of the first set to the front, away from the reflecting surface, and for selectively exposing the image fragments of the second set to the rear, for reflection in the reflecting surface, so that the image fragments of the first set and the image fragments of the second set combine to form first and second image components, respectively, seen by viewing the first set of image fragments directly from the front and by viewing, simultaneously, the second set of image fragments by reflection in the transversely extending reflecting surface so that the first and second image components combine to provide a continuous composite image which cannot be readily predicted by a spectator casually viewing the image surface.

Preferably, the image fragments are formed as strips extending across the image carrying surface parallel to the reflecting surface.

In one version, the image carrying surface is covered by a lenticular screen lens so that image fragment of the first set and the image fragments of the second set can be seen clearly only alternatively by viewing the image carrying surface from respective opposite directions and that the second set can be clearly seen only by reflection in the mirror.

In another version the image carrying surface is corrugated with each corrugation extending parallel to the planar reflecting surface and having the cross-section of an isosceles triangle providing an image carrying surface with first and second upwardly inclined facets alternating as they extend away from the mirror and providing, respectively, first and second sets of image fragments of the first and second image components, facing forwards towards the spectator and rearward for reflection in the mirror respectively.

The image carrying surface may be formed by providing a first picture identical to the composite image and a second picture which is a mirror image thereof, dividing both pictures horizontally at identical locations into upper and lower contiguous portions and dividing the lower portion of the first picture into a series of individual horizontal strips corresponding to image fragments of the first set forming the precursor of the first image component, inverting the second picture and dividing the upper portion of the second picture into a series of individual horizontal strips corresponding to image fragments of the second set to form the precursor of the second image component, and interlacing the individual strips of the first set with the individual strips of the second set.

The amusement device may be incorporated in greetings card with the image carrying face covering the inside of one flap of a folded sheet and the reflecting surface covering the inside of the opposite flap, so that the composite picture, possibly the portrait of the giver or recipient, can be seen when the card is opened with the fold remote from the user to extend the flaps perpendicularly to each other. An analogous application would be in a children's book, possibly pop-up, or with the reflective surface and image carrying surface on adjacent pages.

Another application of the invention resides in interior decoration where an image of an object formed by the image carrying substrate described above in the room reflected from a mirror is different from the image which would be expected by a person looking into the mirror simultaneously viewing or having viewed the image carrying substrate directly when in front of the mirror. Particularly where the image carrying substrate is arranged closely adjacent the mirror, possibly intersecting the mirror plane so that the reflected image would normally be expected to be mirror image extending continuously from the direct image, the appearance of a different, reflected image can provide an impression or illusion that the room is of significantly greater size, extending beyond the mirror plane, a much sought after effect, particularly in city apartments. In a particularly effective version, the image seen in the mirror may be a landscape while the direct images may be of objects expectyed to be seen in the foreground of the landscape.

According to another aspect of the invention, there is provided a room having a wall extending perpendicularly in front of a mirror, the wall having a surface carrying a first set of image fragments and a second set of image fragments for forming, respectively, first and second composite image components, image fragments of the second set being both differently shaped or configured and laterally inverted to image fragments of the first set and arranged alternately along the wall surface to image fragments of the first set, selection means on the wall surface for selectively exposing the image fragments of the first set away from the mirror and for selectively exposing the image fragments of the second set for reflection in the mirror so that the image fragments of the first set and the image fragments of the second set combine to form first and second image components, respectively, seen by a person in front of the mirror viewing the first set of image fragments directly and by viewing, simultaneously, the second set of image fragments by reflection in the mirror so that the first and second image components combine to provide a continuous composite image which cannot be readily predicted by the person casually viewing the image fragments on the wall surface providing the impression that the room is of increased size extending beyond the mirror plane.

The invention further provides a room having a wall extending perpendicularly in front of a mirror, the wall having a surface carrying a first set of image fragments and a second set of image fragments for forming, respectively, first and second images, image fragments of the second set being both differently shaped or configured and laterally inverted to image fragments of the first set and arranged alternately along the wall surface to image fragments of the first set, selection means on the wall surface for selectively exposing the image fragments of the first set away from the mirror for viewing as the first image only directly by a person in front of the mirror and for selectively exposing the image fragments of the second set for viewing, simultaneously, by reflection in the mirror as the second image so that a person in the room sees that the second image is aligned with the first image but different from a mirror reflection of the first image providing the impression that the second image arises from an object behind the mirror and thereby that the room is of increased size extending beyond the mirror plane.

In another application the image carrier surface is mounted in a viewing box covering the top so as to prevent the spectator looking vertically down onto the image carrier so only the first set of image forming fragments can be seen by direct transmission at any time.

BRIEF INTRODUCTION TO THE DRAWINGS

In order that the invention may be readily understood, specific embodiments thereof will now be described with reference to the accompanying drawings in which:

FIGS. 1*a*–1*i* are schematic views illustrating successive steps in forming an amusement device including an image carrier sheet illustrating the head of a bear;

FIG. 2*a* is a schematic plan view of another image carrier sheet in flat condition;

FIGS. 2*b* and 2*c* are schematic perspective views from respective opposite ends of the image carrier sheet of FIG. 2*a* when folded to form corrugations showing the image strips seen directly and by reflection, respectively;

FIG. 3 is a schematic perspective view of the image carrier substrate of FIG. 2*b* mounted on a display box having a lid mounting a suitably positioned mirror to show the resulting composite image;

FIG. 5 is a schematic perspective view of another method of forming an amusement device employing a lenticular screen.

DESCRIPTION OF PARTICULAR EMBODIMENTS

Figure 1B:
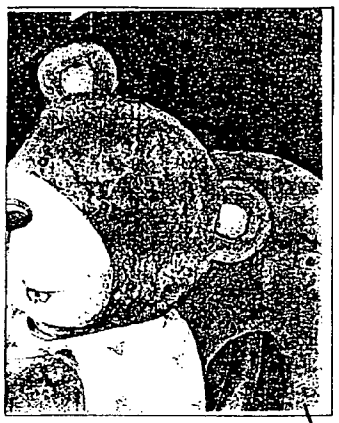
Figure 1D:
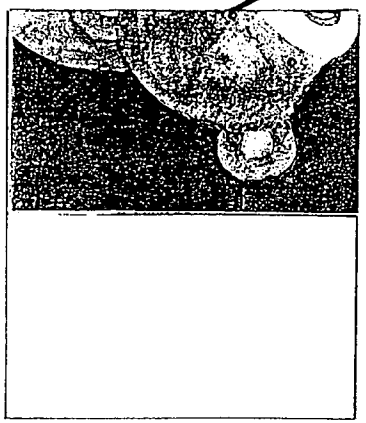
Figure 1F:
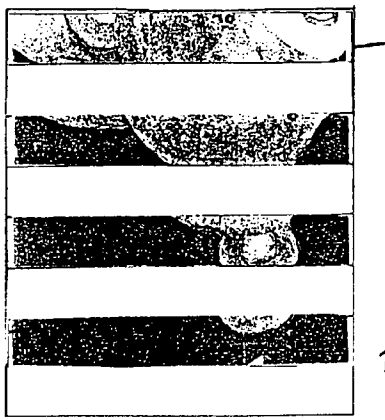
Figure 1G:
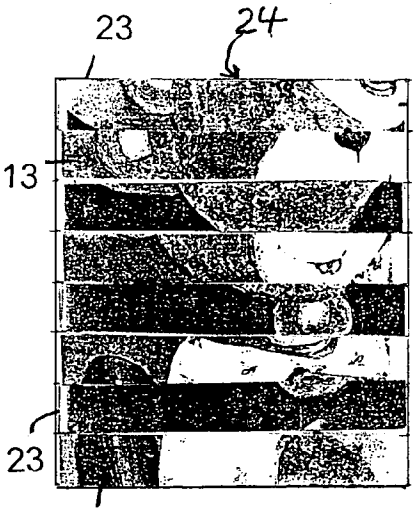
Figure 1A:
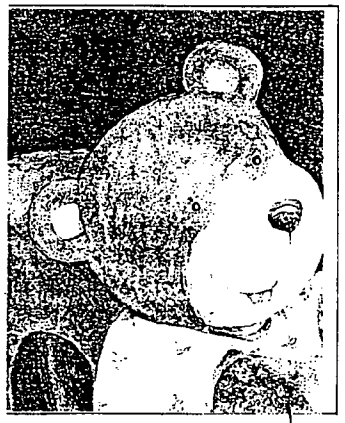
Figure 1C:
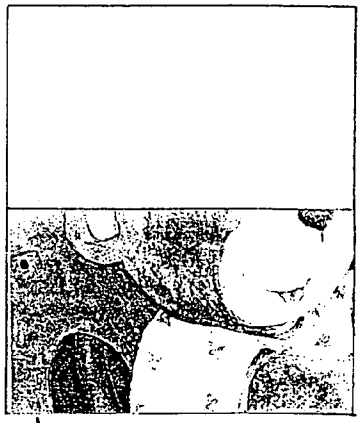
Figure 1E:
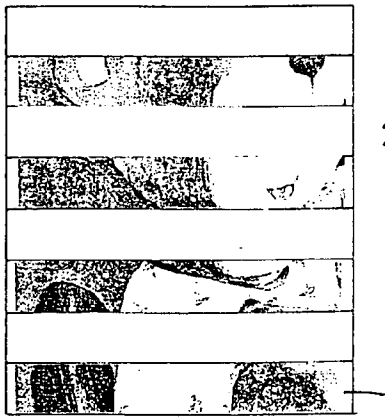

As shown in FIGS. 1*a*–1*g*, an image surface may be formed by providing a first picture 1 shown by FIG. 1*a* identical to the composite image and a second picture 2 which is a mirror image thereof shown by FIG. 1*b*. Respective pictures are then divided horizontally at identical locations into upper and lower contiguous portions 11 and 21 as shown in FIGS. 1*c* and 1*d*, respectively, and the lower portion 11 of the first picture 1 is then divided into a series of individual horizontal strips 13 corresponding to image fragments of a first set forming the precursor of a first image component as shown in FIG. 1*e*. The upper portion 21 of the second picture is inverted and divided into a series of individual horizontal strips 23 corresponding to image fragments of a second set as shown in FIG. 1*f* to form the precursor of a second image component, and the individual strips 13 of the first and second sets are then interlaced so as to be positioned contiguously and alternately, to form an image carrier sheet 24, as shown in FIG. 1*g*.

The division of the pictures into image fragment strips and the manipulation of the image fragment strips for correct positioning can be carried out manually or automatically by a suitably programmed computer.

Figure 1I:
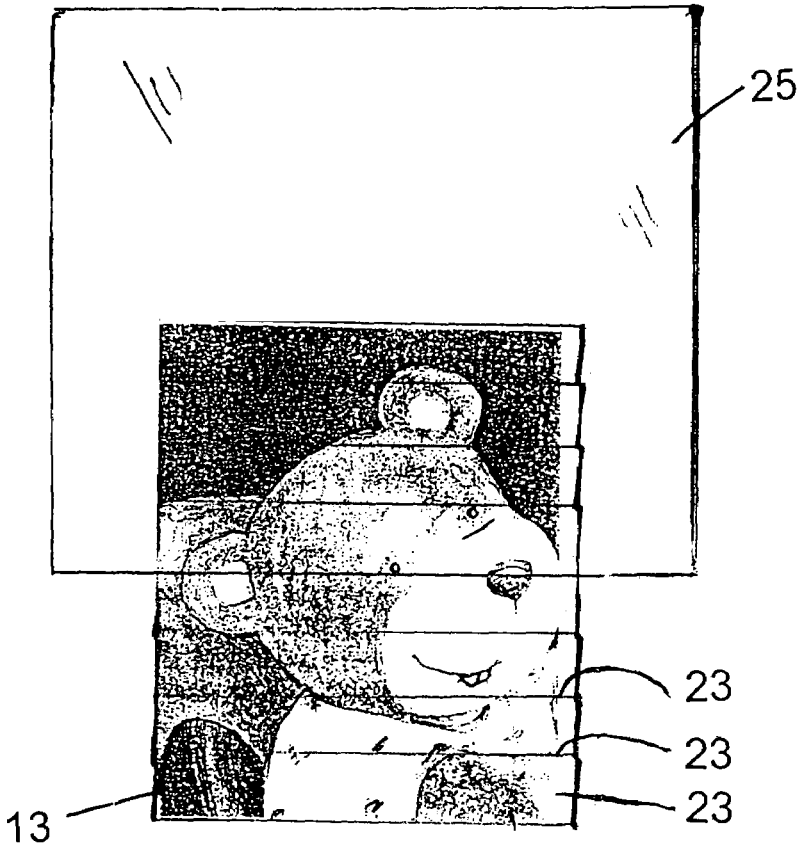
Figure 1H:
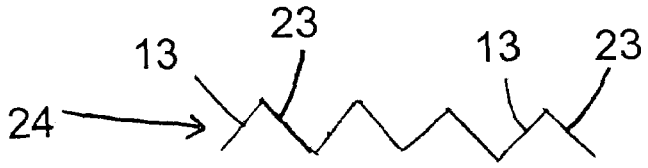

The image carrying sheet 24 is then folded in alternating directions along the boundaries between the respective image fragments or strips forming parallel corrugations, as shown in FIG. 1*h*, and positioned in front of a mirror 25 with each corrugation extending parallel to the planar reflecting surface and having the cross-section of an isosceles triangle providing an image surface with first and second upwardly inclined facets, alternating as they extend away from the reflecting surface thereby positioning, respective first sets of image fragments and second sets of image fragments of the first and second image components, respectively, facing forwards towards the spectator and rearward for reflection by the reflecting surface, respectively, resulting in the image shown in FIG. 1*a* being seen as a composite image partly by direct transmission and partly by reflection, as shown in FIG. 1*i*.

In particular, it will be noted that the composite image is not apparent from glancing directly at the substrate.

In the second example, employing a simple picture of a heart for purposes of easy illustration of the principles underlying the invention, FIG. 2*a* shows the flat substrate or image sheet comprising the alternating image strips 13' and 23' for direct viewing and for viewing by reflection, respectively, and FIGS. 2*b* and 2*c* are views of respective opposite ends of the image carrier sheet/substrate when folded to form corrugations showing the image strips for viewing directly and by reflection, respectively, with the composite image seen when the folded sheet is mounted in a display box with a mirror on the inside of a hinged lid, as shown in FIG. 3 (although the corrugated sheet has more corrugations for a better effect in practice, as shown in FIG. 3).

Alternatively, as shown in FIG. 5, instead of forming corrugations, a suitable lenticular screen 26 may be placed over the flat image carrying sheet, so that image fragment of the first set and the image fragments of the second set can be seen clearly only alternatively by viewing the image surface from respective opposite directions and that the second set can be clearly seen only by reflection in a reflecting surface positioned upright transversely of one end of the image carrying sheet.

Figure 4:
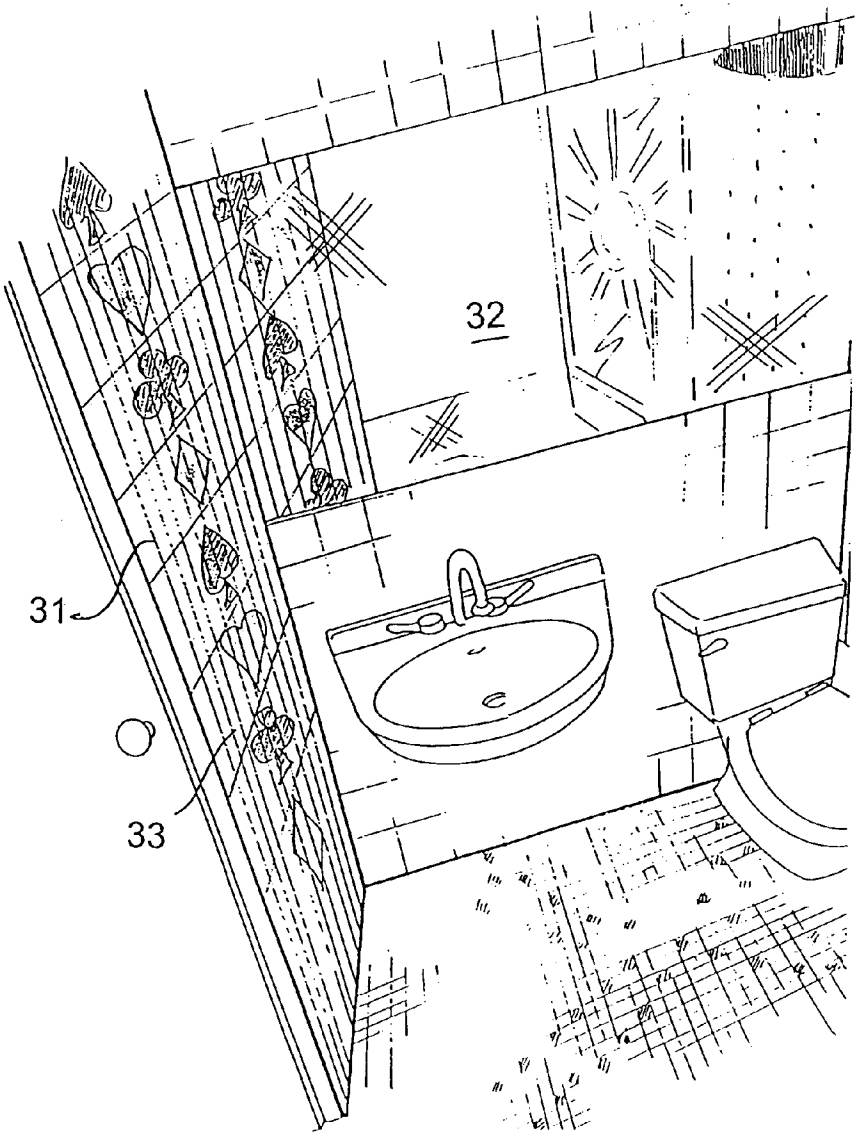
FIG. 4 is a schematic perspective view of the a corner of a bathroom with tiles forming image carrying substrates suitably positioned in front of a mirror showing the different reflected images formed by second sets of image fragments on respective.

According to a third example of the invention shown in FIG. 4, a bathroom has a filed wall 31 extending perpendicularly in front of a mirror 32 with surfaces of respective individual tiles 33 having triangular section corrugations forming first and second sets of inclined facets facing away from and toward the mirror, respectively, and marked with first and second sets of image fragments. Image fragments of the first set combine to form symbols of hearts, clubs, diamonds and spades on respective vertically adjacent tiles when viewed directly by a spectator in front of the mirror while image fragments of the second set combine to form symbols of clubs, diamonds, spades and hearts, respectively, instead of the expected mirror images of the first set.

This is a surprising and, at least initially, puzzling result providing the immediate impression that the second set of images arise from objects behind the mirror plane, with the mirror surface being overlooked providing the impression that the room is of increased size extending beyond the mirror plane.

I claim:

1. An amusement device comprising an image carrying substrate with an image surface having a front end and a rear end and means for providing a reflecting surface extending transversely from the rear end, the image surface being marked with a first set of image fragments and a second set of image fragments for forming, respectively, first and second composite image components, image fragments of the second set being both differently shaped or configured and laterally inverted to image fragments of the first set and arranged alternately along the image surface to image fragments of the first set, selection means on the substrate for selectively exposing the image fragments of the first set to the front, away from the reflecting surface, and for selectively exposing the image fragments of the second set to the rear, for, simultaneous reflection in the reflecting surface, so that the image fragments of the first set and the image fragments of the second set combine to form first and second image components, respectively, seen by viewing the first set of image fragments directly from the front and by viewing, simultaneously, the second set of image fragments by reflection in the transversely extending reflecting surface so that the first and second image components combine to provide a continuous composite image which cannot be readily predicted by a spectator casually viewing the image surface.

2. An amusement device according to claim 1 wherein the image fragments are formed as strips extending across the image surface parallel to the reflecting surface.

3. An amusement device according to claim 2 wherein the selection means comprises corrugations on the image surface wherein each corrugation extends parallel to the reflecting surface and has a triangular cross-section providing the image surface with first and second upwardly inclined facets alternating as they extend away from the reflecting surface and carrying, respectively, the first and second sets of image fragments of the first and second image components, facing forward toward a spectator and rearward for reflection, respectively.

4. An amusement device according to claim 2 wherein the image surface is formed by providing a first picture identical to the composite image and a second picture which is a mirror image thereof, dividing both pictures horizontally at identical locations into upper and lower contiguous portions and dividing the lower portion of the first picture into a series of individual horizontal strips corresponding to image fragments of the first set forming the precursor of the first image component, inverting the second picture and dividing the upper portion of the second picture into a series of individual horizontal strips corresponding to image fragments of the second set to form the precursor of the second image component, and interlacing the individual strips of the first set with the individual strips of the second set so that they are positioned alternately.

* * * * *